US005640982A

United States Patent [19]

Landry et al.

[11] Patent Number: 5,640,982

[45] Date of Patent: Jun. 24, 1997

[54] TANK CLEANING SYSTEM USING COLLAPSIBLE ROBOTIC TANK ENTRY VEHICLE

[75] Inventors: Kenneth Charles Landry; Kermit Ray Arnold, both of League City, Tex.

[73] Assignee: Landry Service Co. Inc., Bacliff, Tex.

[21] Appl. No.: 342,340

[22] Filed: Nov. 18, 1994

[51] Int. Cl.[6] ..... B08B 3/02; B08B 9/093

[52] U.S. Cl. ..... 134/167 R; 239/227; 239/263

[58] Field of Search ..... 134/167 R, 168 R, 134/181; 239/227, 263, 263.3

[56] References Cited

U.S. PATENT DOCUMENTS

| | | | |
|---|---|---|---|
| 2,029,788 | 2/1936 | Ostling | 239/227 |
| 2,109,075 | 2/1938 | Ruth | 239/227 |
| 2,681,250 | 6/1954 | Metcalf et al. | 239/227 |
| 3,001,534 | 9/1961 | Grant, Jr. | 134/167 R |
| 3,052,574 | 9/1962 | Kennedy, Jr. | 134/167 R X |
| 3,351,289 | 11/1967 | Demaison | 239/227 X |
| 4,515,312 | 5/1985 | Manabe et al. | 239/227 X |
| 4,646,768 | 3/1987 | Tanaka et al. | 134/167 R |
| 4,779,798 | 10/1988 | Natolino et al. | 239/227 |
| 4,817,653 | 4/1989 | Krajicek et al. | 134/68 R |

FOREIGN PATENT DOCUMENTS

| | | | |
|---|---|---|---|
| 1213822 | 11/1959 | France | 239/227 |

*Primary Examiner*—Philip R. Coe
*Attorney, Agent, or Firm*—William J. Beard

[57] ABSTRACT

A system for cleaning storage tanks is disclosed having a remotely controlled collapsibile tracked robotic tank entry vehicle, a closed circuit television system for observation including controllable light sources and an articulatible nozzle, also remotely controllable. The nozzle is capable of rotation fully 360 degrees in each of two planes perpendicular to each other under hydraulic control fully independent of its source of cleaning fluid for delivery to the tank.

6 Claims, 3 Drawing Sheets

TANK CLEANING SYSTEM USING COLLAPSIBLE ROBOTIC TANK ENTRY VEHICLE

BACKGROUND OF THE INVENTION

This invention concerns systems for cleaning storage tanks such as are in common usage in petrochemical plants or in oil refineries. More particularly, the invention concerns robotic systems for cleaning such tanks wherein shorter times for cleaning, safer working conditions for workers in the cleaning process, and tighter environmental controls on gaseous or noxious emissions can be achieved than were heretofore obtainable.

Storage tanks having diameters of from 20 to 150 feet are in common usage in refineries and chemical plants. Such tanks are generally closed to the atmosphere by floating or fixed roofs and thereby can contain noxious or aromatic liquids. With passage of time it may be desirable to convert such a tank to a different storage liquid or the tank may become fouled by sediment resulting from a chemical process or by rust, corrosion, or the like, and it becomes necessary to clean the interior of such tanks. Also certain tanks containing pyrophoric materials can be cleaned by this method without removing the purge or by continuously wetting the total internal area of the tank.

BRIEF DESCRIPTION OF THE PRIOR ART

Conventionally workers enter a tank from a manway or entry located near the bottom. Such workers generally must wear protective clothing and use respirators to protect themselves from fumes inside the tank. This can severely limit their work time inside the tank, particularly in hot weather. Such workers, using high pressure hoses and suction lines on the bottom of the tank then apply high pressure water or diluent, such as diesel fuel or light crude oil, to the inside tank surfaces to clean them. Obviously this is highly dangerous and debilitating work.

A robotic system for water washing of such tanks is proposed in U.S. Pat. No. 4,817,653. In this system a worker located inside the tank and in line of sight uses hand controls to control a tracked robot. The hydraulically powered robot carries an articulatable spray head for jetting high pressure water against the interior of the tank. The robot is rather bulky and must be brought disassembled into the tank and then assembled therein for use by the control worker who also resides inside the tank and in line of sight. The robot allows use of higher water pressure than hand held hoses and only one human operator is exposed (at a time) to the tank interior. However, such a worker must still wear protective gear and breathing apparatus and must be replaced frequently, particularly in hot weather.

BRIEF DESCRIPTION OF THE INVENTION

The present invention allows for much safer, faster and environmentally desirable tank cleaning by completely eliminating the need for human workers intervention inside the tank being cleaned. In the present invention an insertion chamber is bolted to the usual manway sized entry (typically 24 inch diameter) to a tank. The insertion chamber includes a protective umbilical tube which is sealed by gasket to the outside atmosphere and which is attached to a dual tracked, hydraulically powered, collapsible robot. A closed circuit television CCTV camera and controllable light source is placed within the tank and used to observe the robot as it proceeds to clean the tank. In its collapsed or compact configuration the robot easily fits within the manway sized insertion chamber. The insertion chamber is equipped with a hinged ramp running from its interior exit passage down to the floor of the tank. Upon command from the remote control console by the operator, who is situated in a comfortable climate controlled operating point a safe distance from the tanks, the collapsed robotic vehicle activates its tracks and advances down the ramp to the floor of the tank. Upon further command the vehicle unfolds itself to its operating configuration, including bringing to an upright position its articulatable, remotely controllable spray head, and expanding its wheel track base for greater stability. The remote operator, then by monitoring the robot on TV monitor screens at the operating console, positions and moves the robotic vehicle about inside the tank as desired and controls the direction and speed of the articulatable spray head as desired to effect complete coverage of the tank interior. The robotic vehicle and the spray head are thus continuously controllable in response to the CCTV to observe the effect of the cleaning jet and to position both the vehicle and the jet efficiently to attain rapid tank cleaning. Of course, evacuation hoses at the bottom of the tank evacuate the cleaning fluid (heated diluent or water) and tank residue slurry to the exterior for processing as desired.

The invention is best understood by reference to the following detailed description thereof, intended as illustrative only and not as limitative, and the accompanying drawings, in which:

DESCRIPTION OF THE PREFERRED EMBODIMENT

Figure 1:
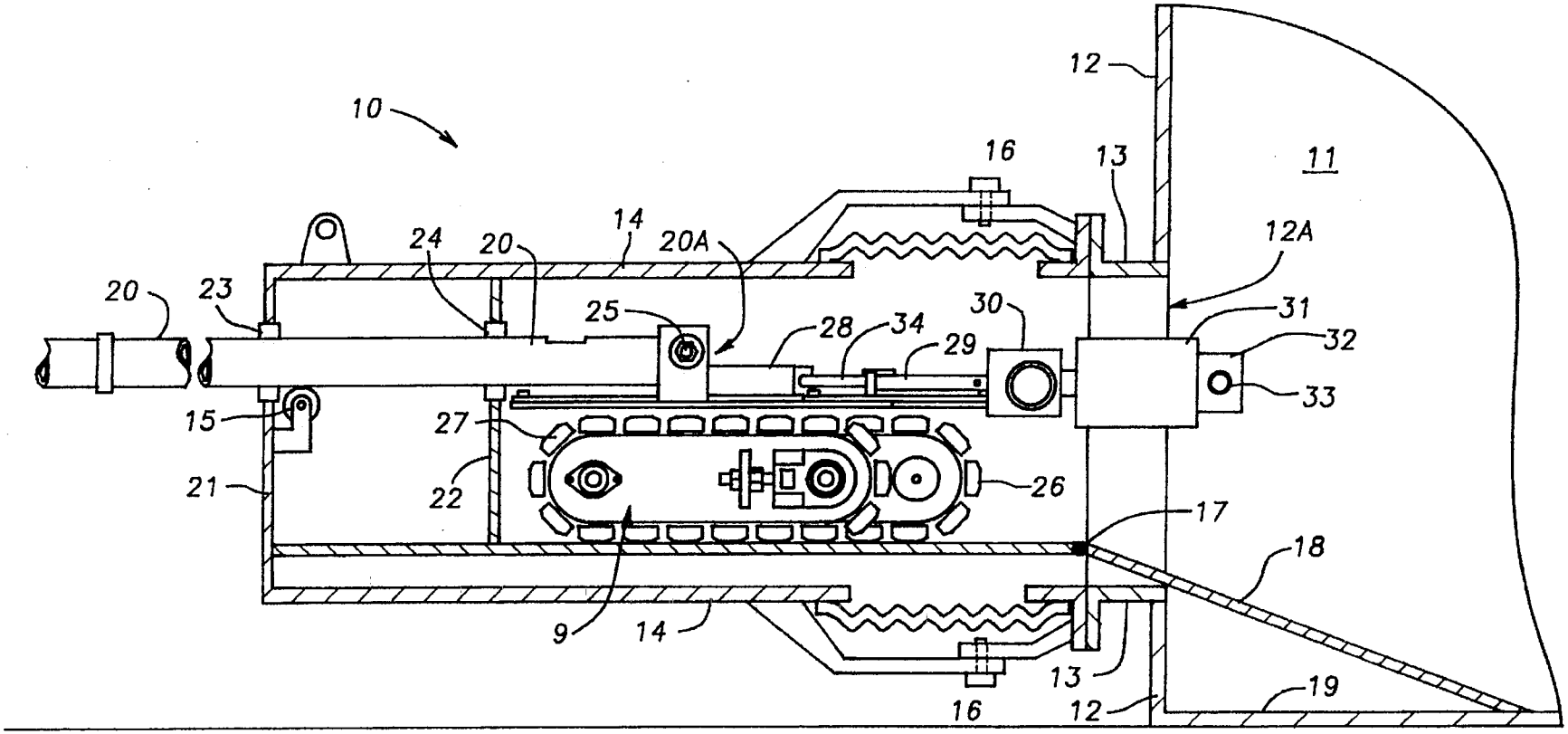
FIG. 1 is a schematic sectional side view showing the robotic vehicle and the insertion chamber of the invention attached to the manway of a tank to be cleaned.
Figure 3A:
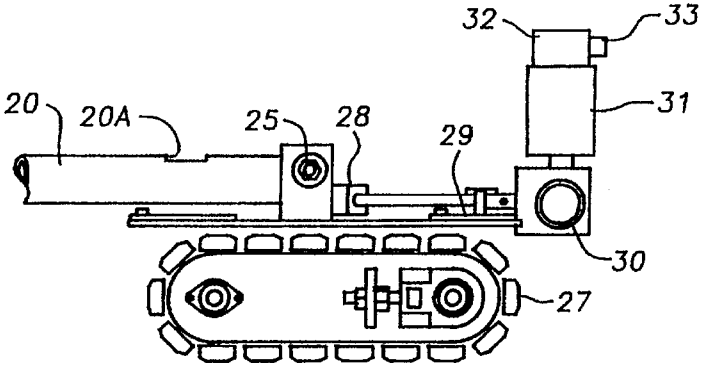
FIG. 3A is a schematic side view of the robotic tracked vehicle of FIG. 1 in its opened position.
Figure 3B:
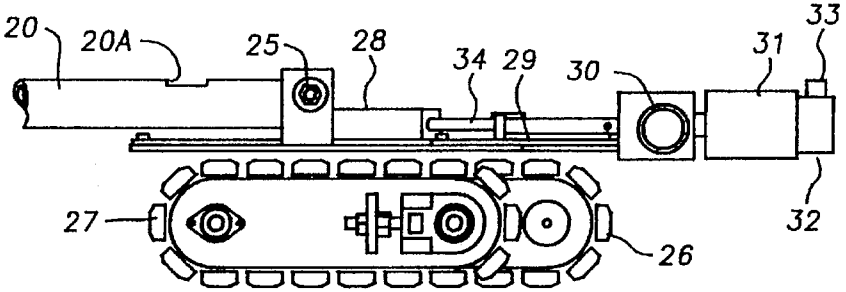
FIG. 3B is a schematic side view in the closed position.
Figure 2A:
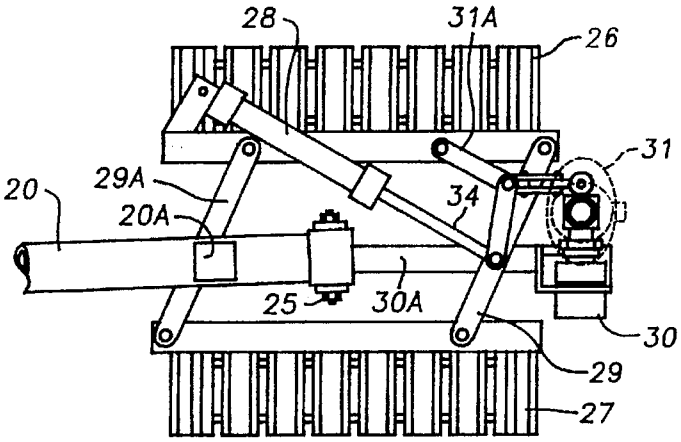
FIG. 2A is a schematic top view of the robotic vehicle of FIG. 1 in its opened or operating position.
Figure 2B:
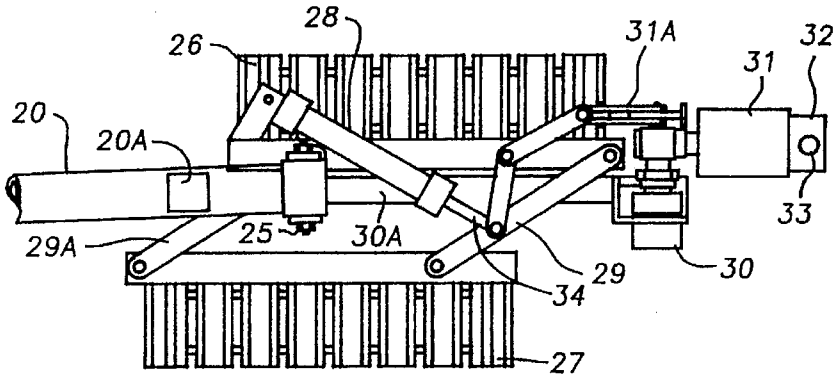
FIG. 2B is a schematic top view of the robotic vehicle of FIG. 1 in its closed or contracted position.
Figure 4A:
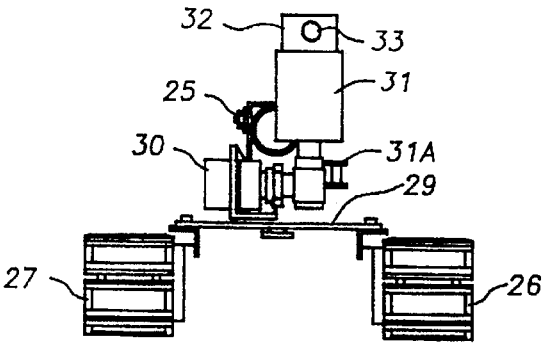
FIG. 4A is a schematic front view of the robotic vehicle of FIG. 1 in its opened position.
Figure 4B:
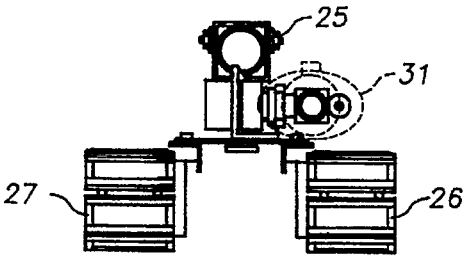
FIG. 4B is a schematic front view in the closed position.

Referring initially to FIG. 1, the collapsible robotic vehicle of the present invention is schematically shown in sectional view inside its insertion chamber attached to a tank to be cleaned. It will be understood that elastomeric hydraulic hoses for operation of the vehicle are provided via an umbilical tube 20, exiting therefrom at an opening 20A provided for this purpose. For purposes of clarity in the drawings of FIGS. 1, 2A, 2B, 3A, 3B, 4A and 4B that these hoses are not shown as they would mask out significant structural details of the vehicle. Thus, while it is understood that such hoses are necessary for the operation of the vehicle, they are omitted for the sake of clarity from these drawings.

A tank 11 to be cleaned is shown sectional in FIG. 1. Tank 11 has sidewalls 12 and floor 19. It is equipped with an entry opening or manway 12A having a circular cross section and being usually about 24 inches in diameter. An insertion chamber, shown generally at 10, houses the dual tracked, collapsible vehicle 9 and is bolted via an adapter 13 to the tank manway 12. The insertion chamber housing 14 is provided with a flange 16 for this purpose.

An umbilical tube 20 of steel or the like enters the insertion chamber housing 14 through its rear wall 21 via an elastomeric gasket 23. The gasket 23 seals the interior of the insertion chamber from outside atmosphere and prevents gases from direct atmospheric exposure. An optional internal baffle wall 22 is provided with a second elastomeric gasket 24 through which the umbilical tube 20 also protrudes to its point of attachment 25 to the vehicle. Gaskets 23 and 24 are made of an elastomeric material such as rubber or polypropylene for the sealing purpose.

The robotic vehicle shown generally at 9 in FIG. 1 is shown in its collapsed or taken down position. In this position one of its tracks 26 is visible in advance of the opposite side track 27. The cleats of tracks 26 and 27 are made of rubber covered bronze to eliminate spark generation. When powered up by flowing hydraulic fluid, the tracks 26 and 27 are operable in either the open or closed (collapsed) positions.

The insertion chamber 10 is provided on its end secured to tank 11 with a ramp 18 hinged thereto at 17 which extends downwardly under the influence of gravity to the floor 19 of tank 11. The vehicle 9 in its collapsed configuration can thus run forward and downward via the ramp 18 into the tank 11 to perform its cleaning.

The vehicle 9 pulls umbilical tube 20 with it as it descends the ramp 18 to the tank floor 19. Upon reaching tank floor 19 the vehicle 9 may be detached from its point of attachment 25 to umbilical tube 20 and may then maneuver about the interior floor 19 of tank 11, propelled by its dual tracks 26 and 27. Prior to this, however, the vehicle 9 is activated by the operator to expand itself from its closed position to its open position. In order to understand this operation in more detail reference is had to FIGS. 2A, 2B, 3A, 3B, 4A and 4B in conjunction with FIG. 1 of the drawings.

The vehicle 9 is equipped with a hydraulic activator cylinder 28 which is capable of extending and retracting the activating arm 34 upon passage of hydraulic fluid therethrough. The hydraulic cylinder 28 is fixedly mounted to the frame of track 26. Tracks 26 and 27 are joined by parallelogram linkage arms 29 and 29A such that when activating arm 34 is extended by the hydraulic cylinder 28 the parallelogram linkages 29 and 29A permits tracks 26 and 27 to rotate about their pivot points and swing into alignment with each other.

The vehicle 9 is equipped with an articulatable nozzle 31 assembly which will be described in more detail later. The nozzle assembly 31 is pivotally mounted to a hydraulic fitting assembly 30 which is fixedly mounted to a longitudinal body member 30A. Body member 30A carries the pivotal attachment point 25 for the umbilical tube 20 and is also attached pivotally to the parallelogram links 29 and 29A. A secondary lever linkage 31A runs between body member 30A, track 26 and pivoted hydraulic fitting assembly 31 and in the closed position is carried folded down or horizontally. Upon activation of the activator arm 34 by hydraulic cylinder 28, the linkage 31A causes the pivotal hydraulic fitting assembly to rotate 90° about its axis, thus rotating the articulatable nozzle assembly 31 to an upright or vertical position.

Thus, in operation the vehicle 9 is activated to power tracks 26 and 27 forward, propelling the vehicle down the ramp 18 in closed position with the articulatable nozzle assembly 31 down. When the floor of the tank is reached, the operator activates the hydraulic cylinder 28, opening the vehicle tracks 26 and 27, centering the body member 28 and rotating the nozzle assembly 31 to its upright position. The vehicle 9 is then detached from the umbilical tube 20 and is free to maneuver about the tank floor 19 under control of the operator.

For control purposes the tank 11 is provided on its interior wall with a light source and a closed circuit television CCTV camera (not shown) over the manway entrance. Thus the location of the vehicle within the tank may be monitored conveniently from a climate controlled operation room located remotely from the tank being cleaned. Appropriate control switches and levers may be mounted on a control console in the operation room to control the vehicle 9 by appropriate switching of hydraulic fluid to the hydraulic hoses (not shown) running via umbilical tube 20 and insertion chamber 10 into the tank 11. All the while the insertion chamber gaskets 23 and 24 keep gases from inside tank 11 from being vented to the atmosphere.

Also supplied via a hose in the umbilical tube 20 is a pressurized supply of tank cleaning fluid. This fluid may comprise water for cleaning some tanks or may comprise a heated or unheated diluent such as diesel fuel or light crude oil for cleaning other tanks, as desired. The hose (not shown) conducts the cleaning fluid of choice via pivotal hydraulic fitting 30 to the articulatable nozzle assembly 31 where it is directed in a controllable manner against the inside tank walls and floor as desired. To this end the articulatable nozzle assembly is provided with a first and second rotatable nozzles 33 whose operation will subsequently be described in more detail.

Figure 5:
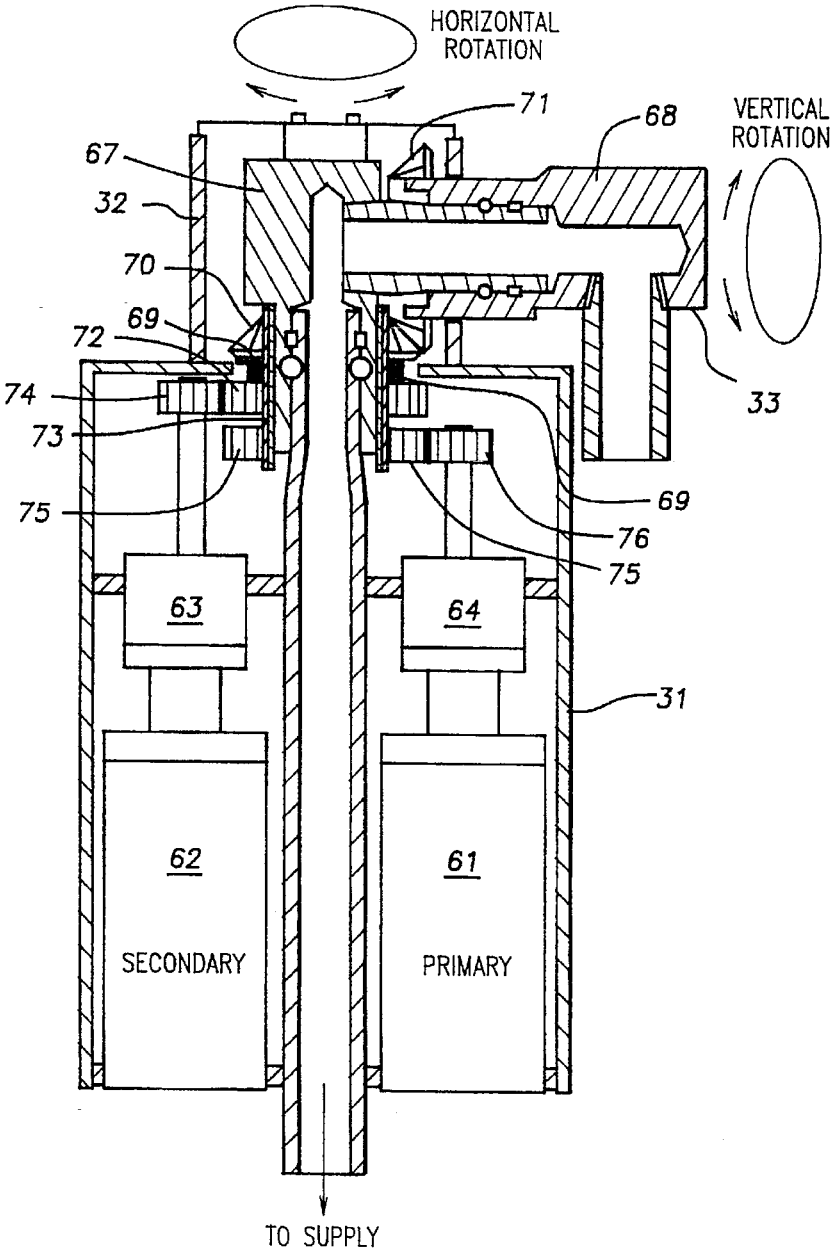
FIG. 5 is a schematic sectional view showing the construction of the controllable, articulatable, spray head used on the robotic vehicle.

Referring now to FIG. 5 the articulatable nozzle assembly is shown in more detail in a schematic sectional view. The assembly comprises an outer case 31, a horizontally rotatable case 32 and a vertically rotatable nozzle 33. The meaning of horizontal and vertical plane rotations are shown by the convention of the circles as shown (FIG.5). The motions of the nozzle are powered by a primary hydraulic motor 61 and a secondary hydraulic motor 62. A unique method of gearing and hydraulic control enables the unit to rotate continuously through 360° in both horizontal and vertical planes without the need to transfer hydraulic power separately to the second rotating stage 33.

A pair of high pressure swivels 67 and 68 are mounted as shown in FIG. 5. On primary swivel 67 a floating set of gears 70, 72 comprising a straight spur gear 72 and a bevel gear 70 locked together by a connecting sleeve 69. These gears are able to rotate freely on a bronze bearing 73. The bevel gear 70 drives a second bevel gear 71 attached to the secondary swivel 68 at a 1:1 ratio. The floating gears 70, 72 are driven by a pinion 74 engaged with spur gear 72. The pinion 74 is driven by the secondary hydraulic motor 62 through a harmonic speed reduction drive 63 at a ratio of, for example, 50:1. Thus rotation of the secondary motor 62 rotates the secondary swivel 68 through the gear chain 70, 72 provided the primary swivel 67 is stationary. This will cause vertical plane rotation in either direction, depending on the direction of rotation of secondary hydraulic motor 62.

The primary swivel 67 has a spur gear 75 directly fixed to it. Spur gear 75 is driven by a pinion 76 which is driven by the primary hydraulic motor 61 via a primary harmonic speed reduction drive 64 which is identical to reduction drive 63. In this arrangement, if the primary motor is driven on its own it will rotate the primary swivel 67 by 360° in the horizontal plane and it will also rotate the secondary swivel 68 in the vertical plane at the same speed provided the floating gear set 70, 72 is not allowed to rotate by the pinion 74.

If both the primary and secondary hydraulic motors 61 and 62 are operated in the same direction at the same speed the primary swivel 67 will rotate in the horizontal plane but the secondary swivel 68 will maintain its position in the vertical plane. This gives a net effect of 360° rotation in only the horizontal plane.

If the two hydraulic motors are connected in "series" to drive them both at the same speed, the position of the secondary swivel 68 (and hence the nozzle 33) can be obtained by feeding only a slight amount of hydraulic fluid into or out of the secondary motor 68 only, thus causing a slight speed differential between the two. Thus this slight differential gives complete control of the position of the nozzle in the vertical plane with this arrangement.

The articulated nozzle assembly thus described is conveniently sized to pass through an 8 inch tank opening. If desired, this assembly can be used directly on the end of an umbilical tube 25 without use of the tracked vehicle to enter a tank to be cleaned. Thus control of the direction of a jet of cleaning fluid is remotely controllable from outside the tank via hydraulic control hoses and the umbilical tube 20 in this configuration as viewed by the CCTV. For cleaning small diameter tanks only this control cable articulatable rotating nozzle assembly may be required.

Summarizing the operation may be described as follows. At the tank floor 19 the hydraulic cylinder 28 powers the actuator arm to spread the tracks 26, 27 of the vehicle 9 and to cause the articulatable nozzle assembly 31 to rotate to a vertical position. The vehicle is then moved about inside the tank and the cleaning fluid directed as desired under CCTV monitor control by the remote operator until the tank is cleaned. Evacuation hoses (not shown) situated on the floor of the tank are used to evacuate the slurry of cleaning fluid and waste material being removed from the tank. The vehicle 9 is moved about as desired and positioned as needed to achieve complete cleaning of the tank internally.

The foregoing descriptions and drawings may make apparent to those of the skill in the art certain changes and modifications to the system of the present invention. It is the aim of the appended claims to cover all such changes and modifications as fall within the true spirit and scope of the invention.

We claim:

1. A system for cleaning large storage tanks having a relatively small access opening therein, comprising:

an artculatable nozzle means capable of insertion into a tank and sized to enter through a relatively small access opening therein, said nozzle means being hydraulically operable by a remotely located controllable supply of hydraulic fluid and being attachable to an umbilical tube for protecting operating cables and hoses upon entry into a tank, said umbilical tube having a sufficient length to place said articulatable nozzle means near the center of said tank for spraying a cleaning fluid, supplied from a separate pressurized supply of tank cleaning fluid, against the interior walls and floor of said tank, said nozzle means being capable of rotation of 360 degrees in each of two planes perpendicular to each other.

2. The system of claim 1 wherein said articulatable nozzle is remotely hydraulically controllable to point in any desired direction.

3. The system of claim 2 wherein said articulatable nozzle further comprises two hydraulic motors and gearing means for separately driving said nozzle in each of said two planes perpendicular to each other independently.

4. The system of claim 3 wherein said two hydraulic motors are connected in series to a hydraulic fluid supply to rotate at the same speed.

5. The system of claim 4 wherein one of said motors is independently connected to a second hydraulic fluid supply to cause a differential in speed of rotation of said motors, said differential being usable to control the position of said nozzle in one of said mutually perpendicular planes of rotation.

6. The system of claim 4 wherein said two hydraulic motors are operated deliberately at different speeds thereby providing complete 360° coverage in each of said two planes perpendicular to each other by said articulatable nozzle.

* * * * *